US011498596B2

(12) United States Patent
Yang et al.

(10) Patent No.: US 11,498,596 B2
(45) Date of Patent: Nov. 15, 2022

(54) DRAFT GEAR, COUPLER AND DRAFT GEAR AND RAILWAY TRAIN

(71) Applicant: CRRC QINGDAO SIFANG ROLLING STOCK RESEARCH INSTITUTE CO., LTD., Qingdao (CN)

(72) Inventors: Huaping Yang, Qingdao (CN); Hui Liu, Qingdao (CN); Gengchang Xie, Qingdao (CN); Shi Liu, Qingdao (CN)

(73) Assignee: CRRC QINGDAO SIFANG ROLLING STOCK RESEARCH INSTITUTE CO., LTD., Qingdao (CN)

( * ) Notice: Subject to any disclaimer, the term of this patent is extended or adjusted under 35 U.S.C. 154(b) by 0 days.

(21) Appl. No.: 17/568,693

(22) Filed: Jan. 4, 2022

(65) Prior Publication Data

US 2022/0126891 A1 Apr. 28, 2022

Related U.S. Application Data

(63) Continuation of application No. PCT/CN2020/077171, filed on Feb. 28, 2020.

(30) Foreign Application Priority Data

Jul. 25, 2019 (CN) ..... 201910675827.7

(51) Int. Cl.
*B61G 9/04* (2006.01)
*B61G 9/20* (2006.01)

(52) U.S. Cl.
CPC ..... *B61G 9/04* (2013.01); *B61G 9/20* (2013.01)

(58) Field of Classification Search
CPC ..... B61G 9/04; B61G 9/20
See application file for complete search history.

(56) References Cited

U.S. PATENT DOCUMENTS

2014/0284297 A1 9/2014 Peckham

FOREIGN PATENT DOCUMENTS

CN 201136511 Y 10/2008
CN 201566647 U 9/2010
(Continued)

OTHER PUBLICATIONS

International Search Report of PCT/CN2020/077171.
(Continued)

*Primary Examiner* — Robert J McCarry, Jr.
(74) *Attorney, Agent, or Firm* — J.C. Patents

(57) ABSTRACT

The present application discloses a draft gear including a buffer assembly; a connection assembly, the connection assembly including a connection body, the connection body has: a first connection part, the first connection part is mutually and horizontally rotatably connected with the buffer assembly, and the first connection part and the buffer assembly have a first rotation center; a second connection part, the second connection part has a connection surface, the second connection part is connected with a train body through the connection surface, and the first rotation center is located on a rear side of the connection surface; a bearing assembly, the bearing assembly is mutually and horizontally rotatably connected with the connection assembly, the bearing assembly and the connection assembly have a second rotation center, the second rotation center is located on a front side of the connection surface; and a self-adaption assembly, the bearing assembly is connected with the buffer assembly by the self-adaption assembly.

20 Claims, 6 Drawing Sheets

(56) References Cited

FOREIGN PATENT DOCUMENTS

| | | | | | |
|---|---|---|---|---|---|
| CN | 201573671 | U | | 9/2010 | |
| CN | 101985302 | A | | 3/2011 | |
| CN | 102632906 | A | | 8/2012 | |
| CN | 102774396 | A | | 11/2012 | |
| CN | 105083318 | A | | 11/2015 | |
| CN | 105593099 | A | | 5/2016 | |
| CN | 106494451 | A | * | 3/2017 | |
| CN | 209126738 | U | | 7/2019 | |
| CN | 110304097 | A | | 10/2019 | |
| DE | 102016125087 | A1 | * | 6/2018 | ..... B61G 7/10 |
| EP | 0608531 | B1 | | 8/1994 | |
| JP | 2013086652 | A | | 5/2013 | |
| JP | 5650089 | B2 | | 1/2015 | |
| WO | WO2013155824 | A1 | | 10/2013 | |
| WO | WO2013185510 | A1 | | 12/2013 | |
| WO | WO2017054476 | A1 | | 4/2017 | |
| WO | WO-2018072611 | A1 | * | 4/2018 | ..... B61F 1/10 |

OTHER PUBLICATIONS

Search Report Of CN201910675827.5.
Extended European Search Report of the parallel application EP20773202.5.

* cited by examiner

DRAFT GEAR, COUPLER AND DRAFT GEAR AND RAILWAY TRAIN

CROSS-REFERENCE TO RELATED APPLICATION

This application is a continuation application of international Application No. PCT/CN2020/077171, filed on Feb. 28, 2020, which in turn claims the priority benefits of Chinese Patent Application No. 201910675827.5, filed on Jul. 25, 2019. The contents of the above identified applications are incorporated herein by reference in their entirety.

TECHNICAL FIELD

This application belongs to the field of railway coupler and draft gears, and in particular to a draft gear, a coupler and draft gear and a railway train.

BACKGROUND OF THE PRESENT INVENTION

The coupler and draft gear is used for traction and coupling between railway trains; in order to reduce longitudinal impact during traction and connection of the trains, the coupler and draft gear includes a draft gear and a coupler device which is connected to the body of a railway train through the draft gear.

Referring to FIG. 1, draft gear in the prior art is generally connected with a train body 4' in a front-mounted manner, that is, the draft gear is mounted on a front end face of train body 41'. Specifically, the draft gear includes a buffer assembly 1', a connection assembly 2' and a rotation assembly 3'; the buffer assembly 1' is rotatably connected with the connection assembly 2' through the rotation assembly 3'; the connection assembly 2' is connected with the train body 4' through a connection piece 5'; and a rotation center 31' of the rotation assembly 3' is in front of the front end face of train body 41'.

The distance between one end surface of the buffer assembly 1' away from the train body 4' and the rotation center of the rotation assembly 3' is defined as the length L of the buffer assembly 1', and the distance from the rotation center to the front end face of train body 41' is A. Thus, the draft gear in the prior art occupies a space with a length of L+A at the train bottom. Due to the increasing functions of the railway train, more and more space of the train bottom is occupied, and the space of the train bottom occupied by the draft gear needs to be reduced under the condition that the length of the coupler remains unchanged.

SUMMARY OF THE PRESENT INVENTION

The present application provides a draft gear, which can reduce the mounting space of the draft gear. In order to realize the above objection, the technical solutions of the present application are as follow.

A draft gear, comprising:

a buffer assembly;

a connection assembly, the connection assembly comprising:

a connection body, the connection body has:

a first connection part, the first connection part is mutually and horizontally rotatably connected with the buffer assembly, and the first connection part and the buffer assembly have a first rotation center;

a second connection part, the second connection part has a connection surface, the second connection part is connected with a train body through the connection surface, and the first rotation center is located on a rear side of the connection surface;

a bearing assembly, the bearing assembly is in mutual contact with the buffer assembly, the bearing assembly is mutually and horizontally rotatably connected with the connection assembly, the bearing assembly and the connection assembly have a second rotation center, the second rotation center is located on a front side of the connection surface; and a self-adaption assembly, the bearing assembly is connected with the buffer assembly by the self-adaption assembly.

In some embodiments, the self-adaption assembly comprises:

first fitting pieces, the first fitting pieces are connected with the buffer assembly; and second fitting pieces, the second fitting pieces are connected with the bearing assembly, the second fitting pieces are fitted with the first fitting pieces, and a fitting surface is a circular arc surface.

In some embodiments, a circle center of the circular arc surface is arranged in a central axis of the buffer assembly.

In some embodiments, the draft gear further comprises an overload protection assembly; the buffer assembly is connected with the first connection part through the overload protection assembly.

In some embodiments, the overload protection assembly comprises:

a protection piece, the protection piece is connected with the buffer assembly; and a shear-off bolt, the protection piece is connected with the first connection part through the shear-off bolt.

In some embodiments, the bearing assembly comprises:

a bearing body;

a second rotation piece, the bearing body is relatively and horizontally rotatably connected with the connection assembly through the second rotation piece;

vertical bearing pieces, the vertical bearing pieces are connected with the bearing body and located on two sides of the buffer assembly, and the vertical bearing pieces are in contact with the buffer assembly; and a horizontal bearing piece, the horizontal bearing piece is located below the buffer assembly, the horizontal bearing piece is abutted against the buffer assembly, the horizontal bearing piece is relatively movably connected with the vertical bearing pieces.

In some embodiments, the bearing assembly further comprises an elastic bearing piece; the elastic bearing piece is connected below the horizontal bearing piece and connected with the bearing body.

In some embodiments, the draft gear further comprises a centering assembly, the centering assembly is connected with the bearing body, and the centering assembly acts on the second rotation piece.

Another aspect of the present application provides a coupler and draft gear comprising the above-mentioned draft gear.

Another aspect of the present application provides a railway train comprising the above-mentioned coupler and draft gear.

Compared with the prior art, the present application has the following beneficial effects:

when the draft gear provided by the present application is mounted for utilization, the distance from one end of the buffer assembly to a connection surface is smaller than the total length of the buffer assembly, and under the condition that the length of the buffer assembly remains unchanged, the draft gear occupies smaller space at the train bottom when being mounted, so that the mounting space of the draft gear is reduced and the mounting compactness is improved.

BRIEF DESCRIPTION OF THE DRAWINGS

FIG. 10 is a top view structure diagram of the draft gear in FIG. 7; in which:

1' buffer assembly; 2' connection assembly; 3' rotation assembly; 4' train body; 41' front end face of train body; 5' connection piece; 1 buffer assembly; 11 first buffer piece; 12 second buffer piece; 2 connection assembly; 21 connection body; 211 first connection part; 212 second connection part; 213 connection hole; 214 connection surface; 22 first rotation piece; 23 first rotation center; 3 bearing assembly; 31 bearing body; 32 vertical bearing piece; 33 horizontal bearing piece; 34 elastic bearing piece; 35 second rotation piece; 36 second rotation center; 4 self-adaption assembly; 41 first fitting piece; 411 fitting surface; 412 circle center; 42 second fitting piece; 5 centering assembly; 6 overload protection assembly; 61 protection piece; 62 shear-off bolt; 7 train body; 71 front end face of train body.

DETAILED DESCRIPTION OF THE PRESENT INVENTION

The following is a detailed description for the technical solutions of the present application in combination with specific implementations. However, it should be understood that, without further recitation, elements, structures and features in one implementation may be beneficially incorporated into other implementations.

In the description of the present application, it is to be understood that terms "first", "second" are merely used for descriptive purpose and should not be interpreted to indicate or imply the relative importance or implicitly indicate the number of technical features indicated. Thus, the features defined by "first" and "second" may explicitly or implicitly include one or more of the features.

Figure 3:
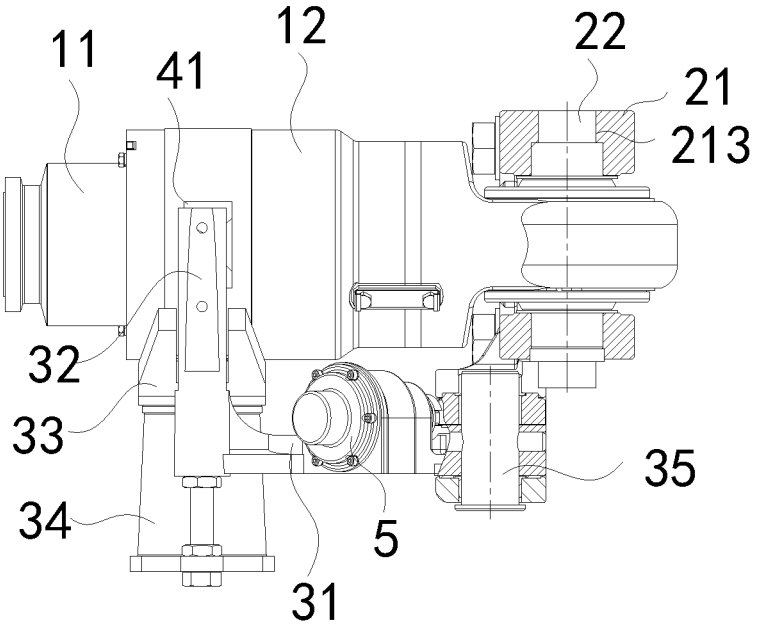
FIG. 3 is a side view structure diagram of the draft gear in FIG. 2.

In the description of the present application, it is to be noted that the direction or positional relationships indicated by terms "upper", "lower", "horizontal" and the like are based on the positional relationships in the FIG. 3, these terms are merely used to facilitate the description of the present application and simplify the description, yet do not indicate or imply that the devices or elements referred must have a particular orientation, be constructed and operated in particular orientation, and therefore should not be interpreted as a limitation on this application.

In the description of the present application, it is to be noted that, unless clearly indicates otherwise, terms "connect", "connection" shall be generally understood, such as, may be fixed connection, detachable connection or integrated connection, may be directly connected, or indirectly connected through intermediate media, or inner communication of two components. For the person skilled in the art, the specific meanings of the above terms in the present application may be interpreted according to specific circumstance.

The implementations are only description for the preferred embodiments of the present application, not a limitation on the scope of the present application, without departing from the design spirit of the present application, all kinds of transformation and modification made by the person skilled in the art to the technical solution of the present application should fall within the protection scope defined by claims of the present application.

Figure 5:
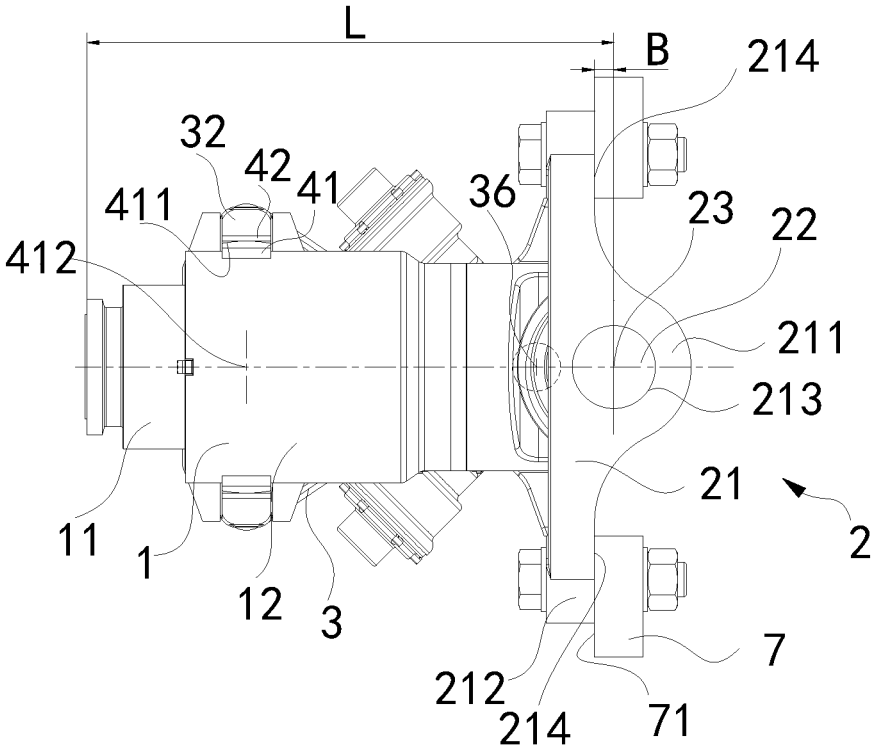
FIG. 5 is a top view structure diagram of the draft gear in FIG. 2.

It should be particularly noted that in order to facilitate the description of the technical solution of the present application, during actual mounting and utilization, the side of the draft gear close to the train body is referred to as a rear side (i.e., close to the right sides in FIG. 3 and FIG. 5), and the side of the draft gear close to the coupler is referred to as a front side (i.e., close to the left side in FIG. 3 and FIG. 5).

A first implementation of the application provides a draft gear, comprising:

a buffer assembly 1;

a connection assembly 2, the connection assembly 2 comprising:

a connection body 21, the connection body 21 has:

a first connection part 211, the first connection part 211 is mutually and horizontally rotatably connected with the buffer assembly 1, and the first connection part 211 and the buffer assembly 1 have a first rotation center 23;

a second connection part 212, the second connection part 212 has a connection surface 214, the second connection part 212 is connected with a train body 7 through the connection surface 214, and the first rotation center 23 is located on a rear side of the connection surface 214;

a bearing assembly 3, the bearing assembly 3 is in mutual contact with the buffer assembly 1, the bearing assembly 3 is mutually and horizontally rotatably connected with the connection assembly 2, the bearing assembly 3 and the connection assembly 2 have a second rotation center 36, and the second rotation center 36 is located on a front side of the connection surface 214; and a self-adaption assembly 4, the bearing assembly 3 is connected with the buffer assembly 1 by the self-adaption assembly 4.

Figure 1:
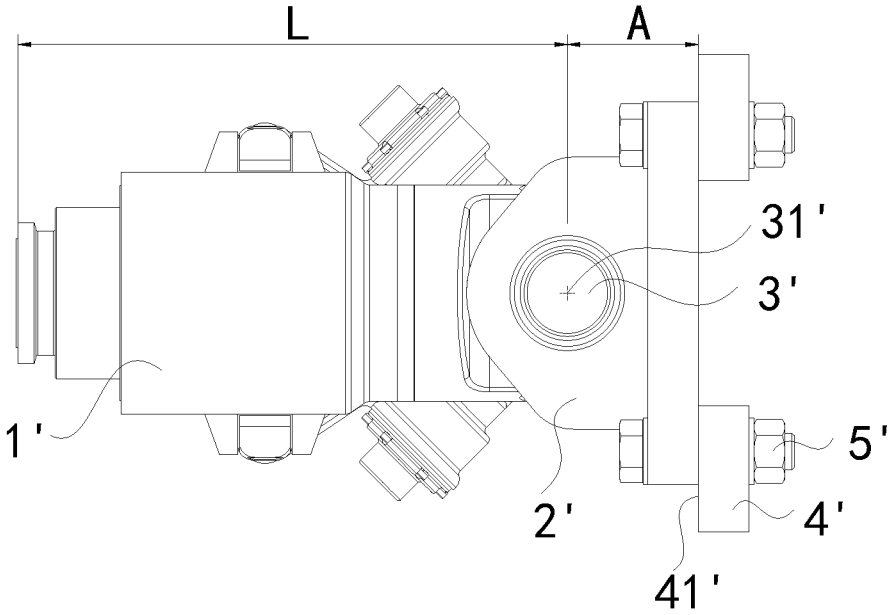
FIG. 1 (PRIOR ART)
FIG. 1 is a structure diagram of a draft gear in the prior art.

Referring to FIGS. 2-5, in the draft gear provided by the first implementation, the buffer assembly 1 is horizontally rotatably connected with the first connection part 211 of the connection assembly 2, and the buffer assembly 1 and the first connection part 211 can make relative rotary motion in a horizontal plane around the first rotation center 23. The train body 7 is connected with the second connection part 212 of the connection assembly 2, the second connection part 212 has the connection surface 214, and the train body 7 is connected to the connection surface 214. The first rotation center 23 is located on the rear side of the connection surface 214. Referring to FIG. 5, the distance from an end surface of the buffer assembly 1 away from the train body 7 to the first rotation center 23 is the length L of the buffer assembly 1. During the actual mounting and utilization, the length L of the buffer assembly 1 does not change. The distance from the first rotation center 23 to the connection surface 214 is B, so the draft gear provided in the first implementation actually occupies a space with a length of L-B at the train bottom. Referring to FIG. 1, which shows a mounting position of the buffer assembly 1' in the draft gear of the prior art, a space with a length of L+A is occupied at the train bottom. Compared with the draft gear of the prior art, the length of the space occupied by the draft gear provided by the first implementation at the train bottom is reduced by A+B. The external space occupied by the draft gear provided in this implementation is reduced under the condition that the length of the buffer assembly 1 remains unchanged. Compared with the draft gear of the prior art, the mounting space is effectively reduced while the buffer capacity remains the same, and the mounting compactness is improved.

In the draft gear provided by the first implementation, the bearing assembly 3 and the buffer assembly 1 are in contact with each other, the bearing assembly 3 is in a mutually and horizontally rotatably connected with the connection assembly 2, the bearing assembly 3 and the connection assembly 2 have the second rotation center 36, and the second rotation center 36 is located on the front side of the connection surface 214. Since the first rotation center 23 is arranged on the rear side of the connection surface 214, a space for accommodating the draft gear needs to be formed inside the train body 7, if the second rotation center 23 is also arranged on the rear side of the connection surface 214, the accommodating space formed inside the train body 7 needs to be enlarged, and if the accommodating space formed is over large, the mounting of railway train floors is affected, which is not applicable to the existing train body structure, and, the strength of the train body 7 is also reduced. Therefore, in the draft gear provided by the first implementation, preferably, the second rotation center 36 of the bearing assembly 3 is arranged on the front side of the connection surface 214, solving the above-mentioned problems, and further reducing the accommodating space required inside the train body.

Figure 6:
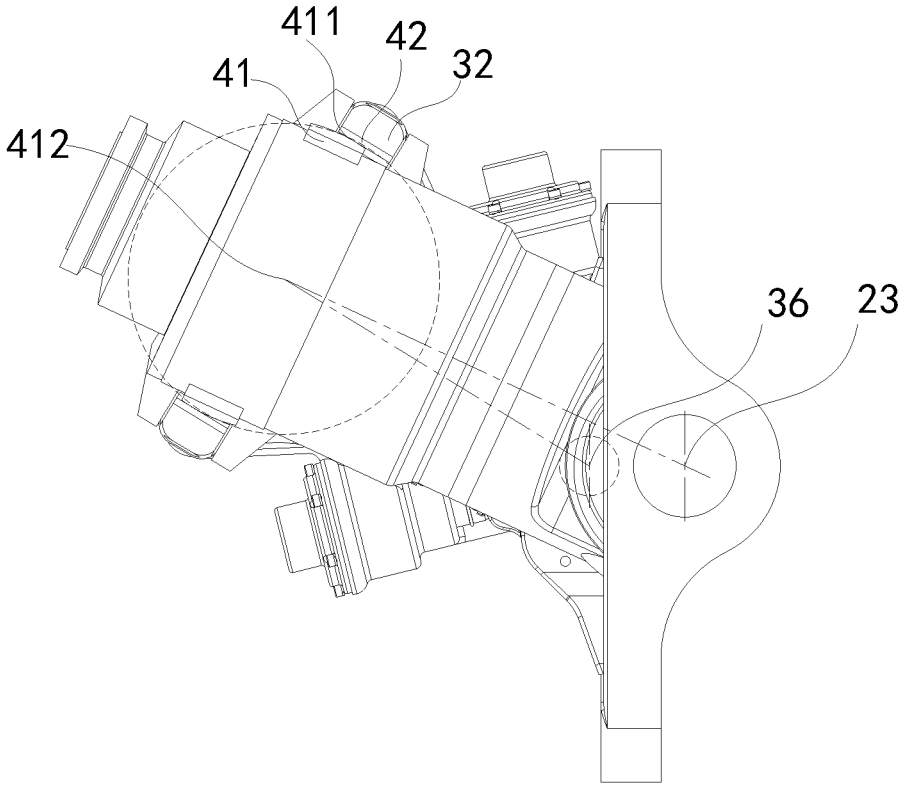
FIG. 6 is a top view structure diagram of the draft gear when rotates horizontally in FIG. 2.
Figure 7:
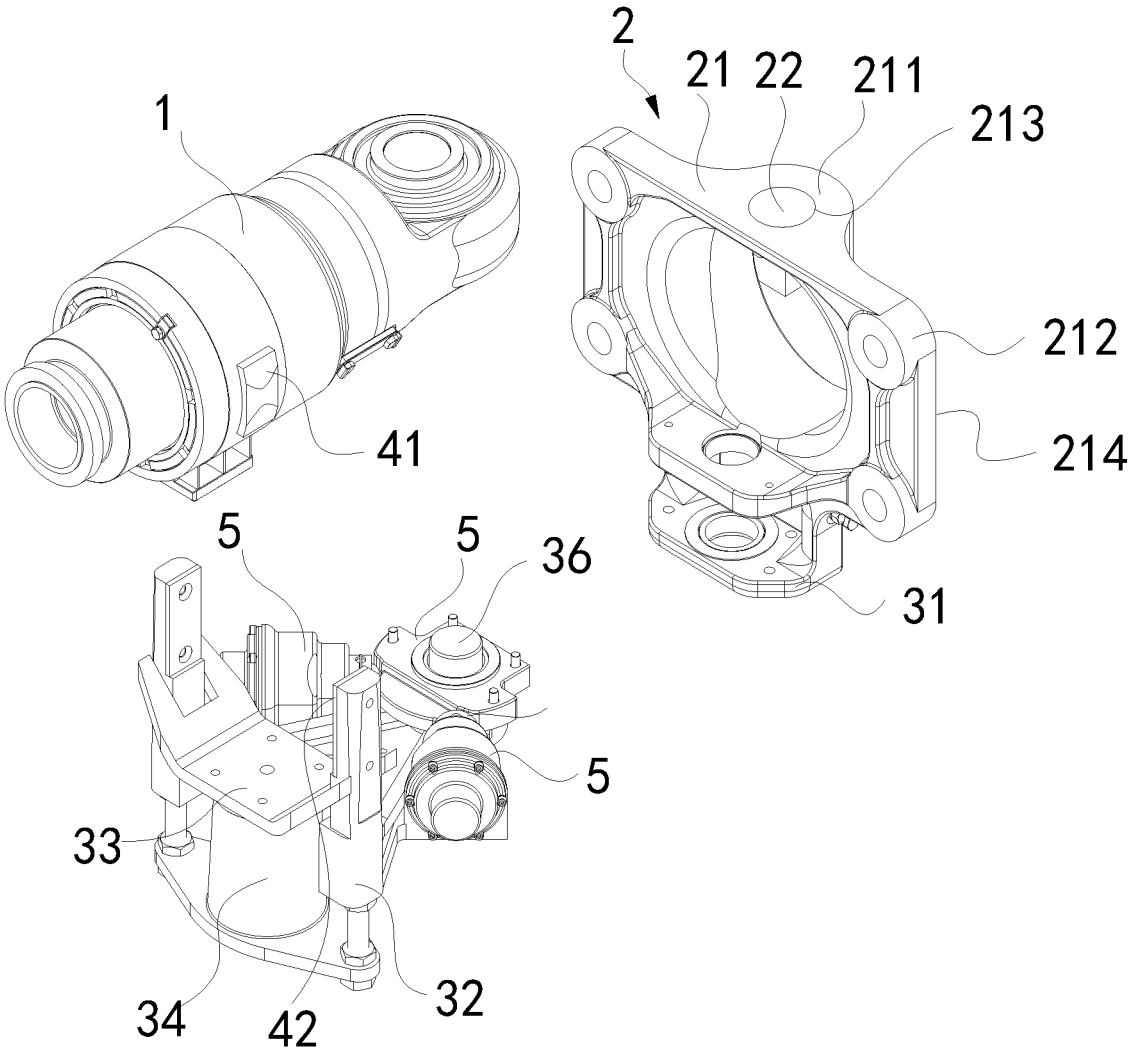
FIG. 7 is an exploded view of the draft gear in FIG. 4.

As shown in FIG. 6, when the railway train turns or bumps, the coupler in the front side drives the buffer assembly 1, and the buffer assembly 1 and the connection assembly 2 make relative rotary motion in the horizontal plane around the first rotation center 23; the buffer assembly 1 drives the bearing assembly 3, and the bearing assembly 3 and the connection assembly 2 make relative rotary motion in a horizontal plane around the second rotation center 36. Since the bearing assembly 3 is in mutual contact with the buffer assembly 1, and the first rotation center 23 and the second rotation center 36 do not coincide and are not in the same vertical line, then the included angle between a central axis of the buffer assembly 1 and a central vertical plane of the train body 7 is inconsistent with the included angle between a central vertical plane of the bearing assembly 3 and the central vertical plane of the train body 7, causing the interference between the buffer assembly 1 and the bearing assembly 3 during the rotary motion, and affecting normal centering of the draft gear. However, in order to avoid affecting the normal centering of the draft gear, it is necessary to increase the gap between the buffer assembly 1 and the bearing assembly 3, which in turn affects the stability and reliability of the coupler coupling. In order to solve this problem, the draft gear provided by the first implementation further comprises the self-adaption assembly 4; the self-adaption assembly 4 connects the bearing assembly 3 and the buffer assembly 1. Specifically, the self-adaption assembly 4 is located between the buffer assembly 1 and the bearing assembly 3 to stabilize a gap between the buffer assembly 1 and the bearing assembly 3. The self-adaption assembly 4 can always keep the gap between the buffer assembly 1 and the bearing assembly 3 consistent, so that the interference between the buffer assembly 1 and the bearing assembly 3 is avoided during the rotary motion, ensuring the normal centering of the draft gear, as well as the stability and reliability of the coupler coupling, and further ensuring the safety of rail vehicles.

Figure 2:
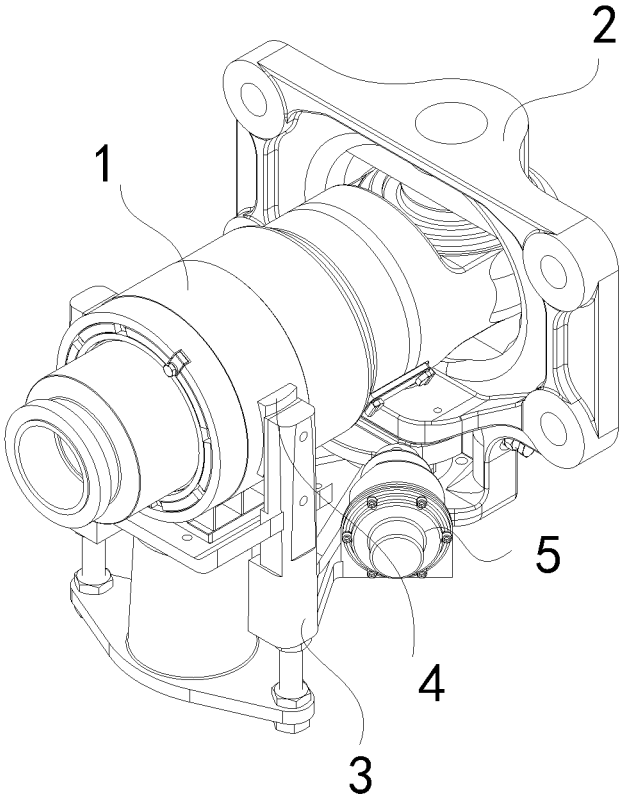
FIG. 2 is a first structure diagram of a draft gear in accordance with one embodiment of the present application.

Specifically, referring to FIG. 2, the draft gear provided by this implementation comprises the buffer assembly 1, the connection assembly 2, the bearing assembly 3, the self-adaption assembly 4 and a centering assembly 5. The buffer assembly 1 is relatively rotatably connected with the train body 7 through the connection assembly 2, the bearing assembly 3 is relatively rotatably connected with the connection assembly 2, the bearing assembly 3 is connected with the buffer assembly 1 through the self-adaption assembly 4, and the centering assembly 5 is connected with the bearing assembly 3. When the railway train runs straightly and smoothly in a straight line, the draft gear is in a centering position, that is, the included angle between the central axis of the buffer assembly 1 and the central vertical plane of the train body 7 is zero, and the included angle between the central vertical plane of the bearing assembly 3 and the central vertical plane of the train body 7 is zero; when the railway train turns or bumps, side of the draft gear will bear force, and the buffer assembly 1 drives the bearing assembly 3 to rotate to one side to allow it to leave the centering position, and the centering assembly 5 also rotates with the bearing assembly 3 to leave the centering position. When the centering assembly 5 deviates from the centering position, a deflection force will be generated, and after the force applied on the side of the draft gear disappears, the deflection force forces the centering assembly 5 to return to the centering position, to drive the bearing assembly 3 to return to the centering position accordingly, and the buffer assembly 1 also follows the bearing assembly 3 to return to the centering position.

Figure 4:
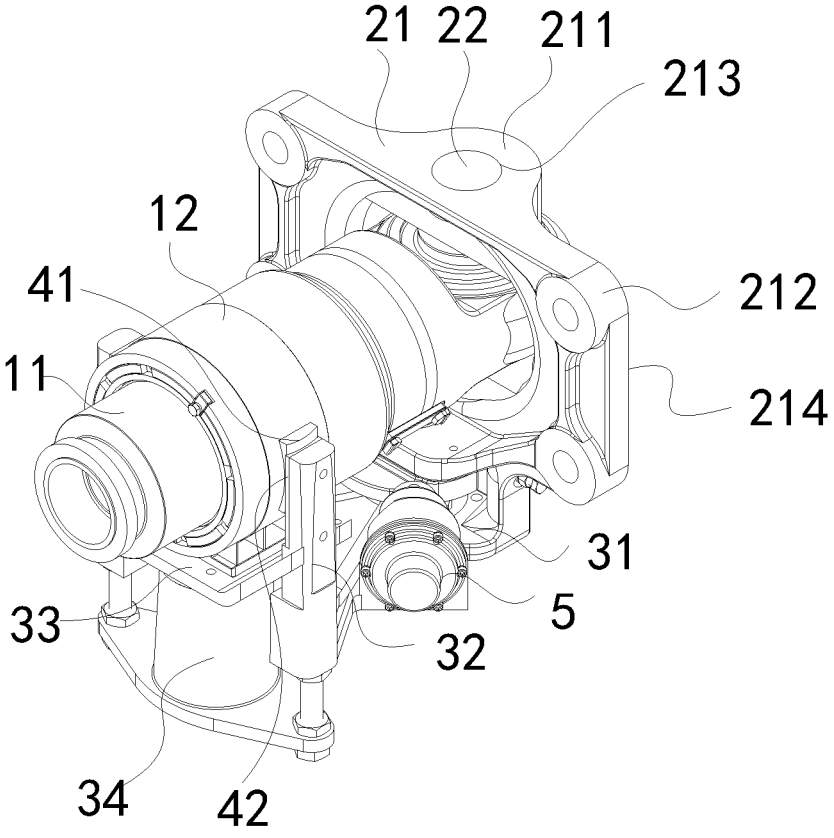
FIG. 4 is a second structure diagram of the draft gear in FIG. 2.

The buffer assembly 1 is a key component of the draft gear and provides a buffer effect for the coupler and draft gear of the railway train. Referring to FIG. 3 to FIG. 5, the buffer assembly 1 comprises a first buffer piece 11 and a second buffer piece 12, the first buffer piece 11 is relatively movably connected with the second buffer piece 12, the first buffer piece 11 is connected with a coupler, and the second buffer piece 12 is connected with the connection assembly 2.

The connection assembly 2 provides connection and supporting for the buffer assembly 1. Referring to FIG. 3 to FIG. 5, the connection assembly 2 comprises a connection body 21 and a first rotation piece 22. The connection body 21 is relatively rotatably connected with the buffer assembly 1 through the first rotation piece 22. The connection body 21 has a first connection part 211 and a second connection part 212. The first connection part 211 is relatively rotatably connected with the buffer assembly 1, and the second connection part 212 is connected with the train body 7. Specifically, a connection hole 213 is formed in the first connection part 211, and the first rotation piece 22 passes through the connection hole 213 to horizontally rotatably connect with the buffer assembly 1. The first rotation piece 22 has a first rotation center 23, and the buffer assembly 1 and the connection body 21 can make relative rotary motion in a horizontal plane around the first rotation center 23. The second connection piece 212 has a connection surface 214, the train body 7 has a front end face of train body 71, and the second connection part 212 is connected with the train body 7 by bolts, so that the connection surface 214 is fitted with the front end face of train body 71. The first rotation center 23 is located on the rear side of the connection surface 214.

The bearing assembly 3 provides support for the buffer assembly 1, and when the buffer assembly 1 rotates horizontally relative to the connection assembly 2, the bearing assembly 3 also rotates horizontally relative to the connection assembly 2 at the same time. Specifically, referring to FIG. 3 and FIG. 4, the bearing assembly 3 comprises a bearing body 31, vertical bearing pieces 32, a horizontal bearing piece 33, an elastic supporting piece 34 and a second rotation piece 35. The bearing body 31 is relatively and horizontally rotatably connected with the connection assembly 2 through the second rotation piece 35, the second rotation piece 35 has a second rotation center 36; the bearing body 31 and the connection assembly 2 can make a relative rotary motion around the second rotation center 36 in a horizontal plane. The vertical bearing pieces 32 provide vertical support for the buffer assembly 1, the vertical bearing pieces 32 are connected with the bearing body 31 and located on two sides of the buffer assembly 1, and each of the vertical bearing piece 32 is in contact with the buffer assembly 1. The two vertical bearing pieces 32 are respectively located on the two sides of the buffer assembly 1, and each vertical bearing piece 32 is connected with the bearing body 31 and is in contact with the buffer assembly 1. The horizontal bearing piece 33 forms a horizontal support surface which provides horizontal bearing for the buffer assembly 1, the horizontal bearing piece 33 is located below the buffer assembly 1, the horizontal bearing piece 33 is abutted against the buffer assembly 1, the horizontal bearing piece 33 is relatively movably connected with the vertical bearing pieces 32; and when the vertical position of the buffer assembly 1 changes, the horizontal bearing piece 33 can move towards the vertical bearing pieces 32, so that the horizontal bearing piece 33 can still be in contact with the buffer assembly 1 to provide a horizontal support force for the buffer assembly 1. In order to further improve the stability of the horizontal support force provided by the horizontal bearing piece 33, in the draft gear provided by the first implementation, the bearing assembly 3 further comprises an elastic bearing piece 34, the elastic bearing piece 34 is connected below the horizontal bearing piece 33 and connected with the bearing body 31, the elastic bearing piece 34 applies an upward force to the horizontal bearing piece 33, so that the horizontal bearing piece 33 is kept in contact with the buffer assembly 1, improving the stability of the horizontal bearing force and further the mounting stability of the buffer assembly 1.

Since the first rotation center 23 and the second rotation center 36 do not coincide and are not in the same vertical line, and during the rotary motion, the included angle between the central axis of the buffer assembly 1 and the central vertical plane of the train body 7 is inconsistent with the included angle between the central vertical plane of the bearing assembly 3 and the central vertical plane of the train body 7, causing the interference between the buffer assembly 1 and the bearing assembly 3 during the rotary motion, and affecting normal centring of the draft gear. However, in order to avoid affecting the normal centering of the draft gear, it is necessary to increase the gap between the buffer assembly 1 and the bearing assembly 3, which in turn affects the stability and reliability of the coupler coupling. The draft gear provided by the first implementation further comprises the self-adaption assembly 4, the self-adaption assembly 4 is used to adjust the gap between the buffer assembly 1 and the bearing assembly 3, such that the gap between the buffer assembly 1 and the bearing assembly 3 is kept consistent, so that the interference between the buffer assembly 1 and the bearing assembly 3 is avoided during the rotary motion, ensuring the normal centering of the draft gear as well as the stability and reliability of the coupler coupling, and further ensuring the safety of the rail vehicles.

Specifically, referring to FIG. 3 to FIG. 7, the self-adaption assembly 4 comprises first fitting pieces 41 and second fitting pieces 42, the first fitting pieces 41 are connected with the buffer assembly 1, and the second fitting pieces 42 are connected with the bearing assembly 3, the second fitting pieces 42 are fitted with the first fitting pieces 41, and a fitting surface 411 is a circular arc surface. When the buffer assembly 1, the bearing assembly 3 and the connection assembly 2 undergo relative rotary motion in a horizontal plane, the buffer assembly 1 and the bearing assembly 3 are in contact with each other through the fitting surface 411 and move relative to each other along the fitting surface 411. The first fitting pieces 41 are connected with the buffer assembly 1, therefore, two of the first fitting pieces 41 are located on two sides of the buffer assembly 1, and the each first fitting piece 41 is connected with the buffer assembly 1. Two of the second fitting pieces 42 are located on the two sides of the buffer assembly 1, the each second fitting piece 42 is fitted with the first fitting pieces 41 and the two second fitting pieces 42 are respectively connected with two vertical bearing pieces 32. Since the fitting surface 411 is in a circular arc shape, the gap between the buffer assembly 1 and the bearing assembly 3 is kept consistent, that is, the gap between the buffer assembly 1 and the horizontal bearing piece 33 and the gap between the buffer assembly 1 and the vertical bearing pieces 32 are kept stable, so that the interference between the buffer assembly 1 and the bearing assembly 3 is avoided, and the stability and reliability of the coupler connection are ensured. Preferably, a circle center 412 of the circular arc surface is arranged in the central axis of the buffer assembly 1, so that the gap between the buffer assembly 1 and the bearing assembly 3 can be further reduced, and the stability and reliability of the coupler connection is further improved.

When the railway train turns or bumps, the coupler drives the buffer assembly 1 and the connection assembly 2 undergo relative rotary motion; in order to enable the buffer assembly 1 to automatically return to its initial position, the draft gear provided by the first implementation further comprises the centering assembly 5, the centering assembly 5 is connected with the bearing body 31, and the centering assembly 5 acts on the second rotation piece 35. When the external force that causes the relative rotary motion between the buffer assembly 1 and the connection assembly 2 disappears, the centering assembly 5 acts on the second rotation part 35, and drives the second rotation part 35 to move, thus the buffer assembly 1 is driven to return to its initial location.

Figure 8:
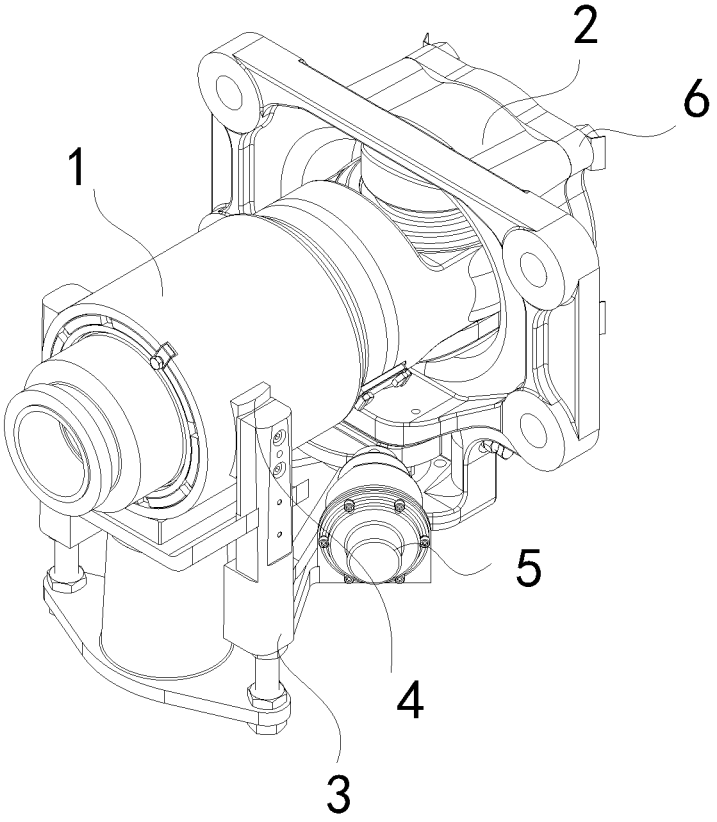
FIG. 8 is a structure diagram of a draft gear in accordance with another one embodiment of the present application.
Figure 9:
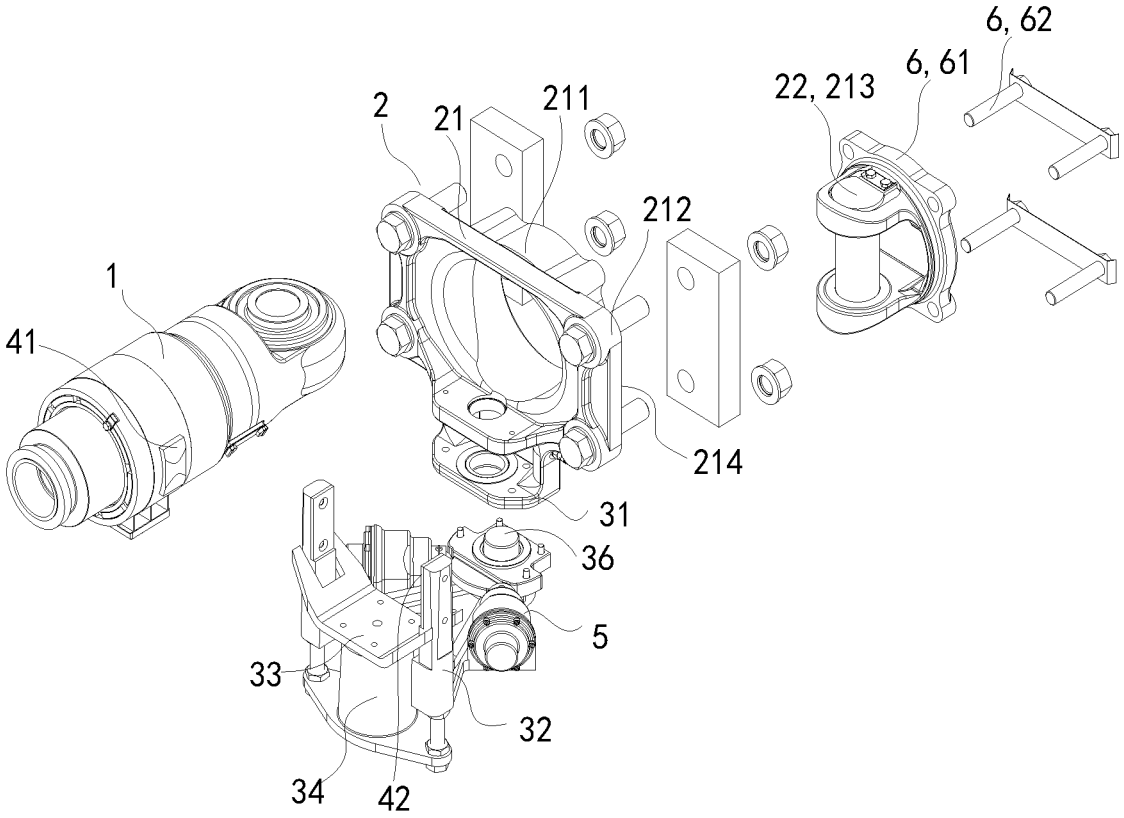
FIG. 9 is an exploded view of the draft gear in FIG. 8.
Figure 10:
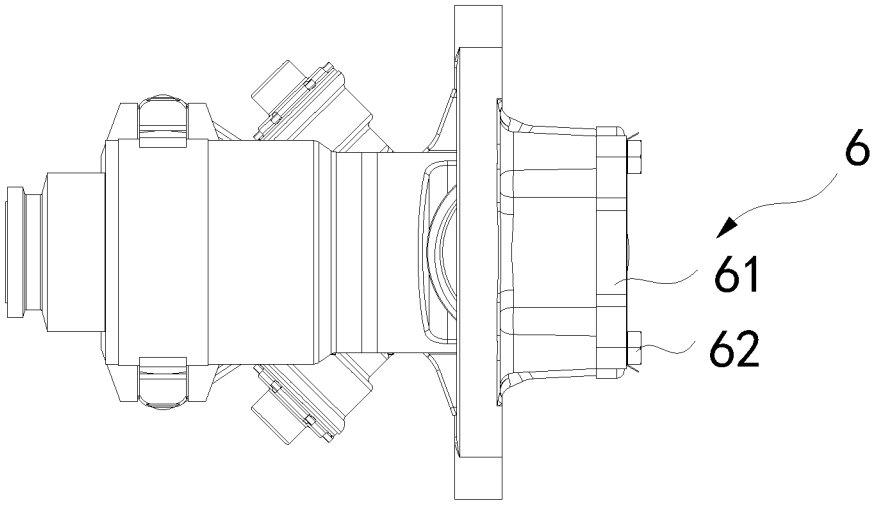

Referring to FIG. 8 to FIG. 10, the draft gear provided by the first implementation further comprises an overload protection assembly 6, and the buffer assembly 1 is connected with the first connection part 211 through the overload protection assembly 6. Specifically, the overload protection assembly 6 comprises a protection piece 61 and a shear-off bolt 62, the protection piece 61 is connected with the buffer assembly 1, the protection piece 61 is connected with the first connection part 211 through the shear-off bolt 62, that is, the protection piece 61 is relatively rotatably connected with the buffer assembly 1 through the first rotation piece 22, the protection piece 61 is connected with the first connection part 211 of the connection body through the shear-off bolt 62. The connection body 21 is relatively rotatably connected with the buffer assembly 1 through the protection piece 61 connected with the first rotation piece 22, and the connection surface 214 of the first connection part 211 is connected with the front end face of train body 71, when the impact force received by the railway coupler is large, the coupler pushes the draft gear to move towards the rear side, and when the moving distance exceeds the buffer stroke of the draft gear, the buffer assembly 1 continues to move towards the rear side. The buffer assembly 1 is connected with the connection assembly 2 through the shear-off bolt 62, when the impact force is too large, the force separating the buffer assembly 1 and the connection assembly 2 from each other is larger than the force that the shear-off bolt 62 can bear, and the shear-off bolt 62 breaks, so that the connection surface 214 is disengaged from the front end face of train body 71, and the first connection part 211 is further disengaged from the train body 7 to prevent the buffer assembly 1 from further damaging the train body 7, thus improve the safety of the railway train.

A second implementation further provides a coupler and draft gear comprising the above-mentioned draft gear.

A third implementation further provides a railway train comprising the above-mentioned coupler and draft gear.

The invention claimed is:

1. A draft gear, comprising:

a buffer assembly;

a connection assembly, the connection assembly comprising:

a connection body, the connection body has:

a first connection part, the first connection part is mutually and horizontally rotatably connected with the buffer assembly, and the first connection part and the buffer assembly have a first rotation center;

a second connection part, the second connection part has a connection surface, the second connection part is connected with a train body through the connection surface, and the first rotation center is located at a first side of the connection surface towards the train body;

a bearing assembly, the bearing assembly is in mutual contact with the buffer assembly, the bearing assembly is mutually and horizontally rotatably connected with the connection assembly, the bearing assembly and the connection assembly have a second rotation center, the second rotation center is located at a second side of the connection surface towards the buffer assembly; and a self-adaption assembly, the bearing assembly is connected with the buffer assembly by the self-adaption assembly.

2. The draft gear of claim 1, wherein the self-adaption assembly comprises:

first fitting pieces, the first fitting pieces are connected with the buffer assembly; and second fitting pieces, the second fitting pieces are connected with the bearing assembly, the second fitting pieces are fitted with the first fitting pieces, and a fitting surface is a circular arc surface.

3. The draft gear of claim 2, wherein a circle center of the circular arc surface is arranged in a central axis of the buffer assembly.

4. The draft gear of claim 1, further comprising an overload protection assembly, wherein the buffer assembly is connected with the first connection part through the overload protection assembly.

5. The draft gear of claim 4, wherein the overload protection assembly comprises:

a protection piece, the protection piece is connected with the buffer assembly; and a shear-off bolt, the protection piece is connected with the first connection part through the shear-off bolt.

6. The draft gear of claim 1, wherein the bearing assembly comprises:

a bearing body;

a second rotation piece, the bearing body is relatively and horizontally rotatably connected with the connection assembly through the second rotation piece;

vertical bearing pieces, the vertical bearing pieces are connected with the bearing body and located on two sides of the buffer assembly, and the vertical bearing pieces are in contact with the buffer assembly; and a horizontal bearing piece, the horizontal bearing piece is located below the buffer assembly, the horizontal bearing piece is abutted against the buffer assembly, the horizontal bearing piece is relatively movably connected with the vertical bearing pieces.

7. The draft gear of claim 2, wherein the bearing assembly comprises:

a bearing body;

a second rotation piece, the bearing body is relatively and horizontally rotatably connected with the connection assembly through the second rotation piece;

vertical bearing pieces, the vertical bearing pieces are connected with the bearing body and located on two sides of the buffer assembly, and the vertical bearing pieces are in contact with the buffer assembly; and a horizontal bearing piece, the horizontal bearing piece is located below the buffer assembly, the horizontal bearing piece is abutted against the buffer assembly, the horizontal bearing piece is relatively movably connected with the vertical bearing pieces.

8. The draft gear of claim 3, wherein the bearing assembly comprises:

a bearing body;

a second rotation piece, the bearing body is relatively and horizontally rotatably connected with the connection assembly through the second rotation piece;

vertical bearing pieces, the vertical bearing pieces are connected with the bearing body and located on two sides of the buffer assembly, and the vertical bearing pieces are in contact with the buffer assembly; and a horizontal bearing piece, the horizontal bearing piece is located below the buffer assembly, the horizontal bearing piece is abutted against the buffer assembly, the horizontal bearing piece is relatively movably connected with the vertical bearing pieces.

9. The draft gear of claim 4, wherein the bearing assembly comprises:

a bearing body;

a second rotation piece, the bearing body is relatively and horizontally rotatably connected with the connection assembly through the second rotation piece;

vertical bearing pieces, the vertical bearing pieces are connected with the bearing body and located on two sides of the buffer assembly, and the vertical bearing pieces are in contact with the buffer assembly; and a horizontal bearing piece, the horizontal bearing piece is located below the buffer assembly, the horizontal bearing piece is abutted against the buffer assembly, the horizontal bearing piece is relatively movably connected with the vertical bearing pieces.

10. The draft gear of claim 5, wherein the bearing assembly comprises:

a bearing body;

a second rotation piece, the bearing body is relatively and horizontally rotatably connected with the connection assembly through the second rotation piece;

vertical bearing pieces, the vertical bearing pieces are connected with the bearing body and located on two sides of the buffer assembly, and the vertical bearing pieces are in contact with the buffer assembly; and a horizontal bearing piece, the horizontal bearing piece is located below the buffer assembly, the horizontal bearing piece is abutted against the buffer assembly, the horizontal bearing piece is relatively movably connected with the vertical bearing pieces.

11. The draft gear of claim 6, wherein the bearing assembly further comprises an elastic bearing piece, the elastic bearing piece is connected below the horizontal bearing piece and connected with the bearing body.

12. The draft gear of claim 6, further comprising a centering assembly, wherein the centering assembly is connected with the bearing body, and the centering assembly acts on the second rotation piece.

13. A coupler and draft gear comprising the draft gear of claim 1.

14. A coupler and draft gear comprising the draft gear of claim 2.

15. A coupler and draft gear comprising the draft gear of claim 3.

16. A coupler and draft gear comprising the draft gear of claim 4.

17. A coupler and draft gear comprising the draft gear of claim 5.

18. A coupler and draft gear comprising the draft gear of claim 6.

19. A coupler and draft gear comprising the draft gear of claim 7.

20. A railway train comprising the coupler and draft gear of claim 13.

* * * * *